US006494123B2

(12) United States Patent
Fuchs

(10) Patent No.: US 6,494,123 B2
(45) **Date of Patent: *Dec. 17, 2002**

(54) ROTARY BLADE ROLL

(75) Inventor: Siegfried Fuchs, Neuwied (DE)

(73) Assignee: Winkler & Dünnebier Aktiengesellschaft, Neuwied (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/565,511

(22) Filed: May 5, 2000

(65) Prior Publication Data

US 2002/0092399 A1 Jul. 18, 2002

(30) Foreign Application Priority Data

Jun. 4, 1999 (DE) ..... 199 25 612

(51) Int. Cl.[7] ..... B26D 7/26; B31B 19/14

(52) U.S. Cl. ..... 83/698.51; 83/100; 83/663; 83/698.21

(58) Field of Search ..... 83/698.21, 698.41, 83/698.42, 698.51, 698.61, 100, 663

(56) References Cited

U.S. PATENT DOCUMENTS

| | | | | | |
|---|---|---|---|---|---|
| 3,752,042 | A | * | 8/1973 | Castille | 83/698.51 X |
| 4,343,215 | A | * | 8/1982 | Fuchs | 83/698.41 X |
| 4,671,152 | A | * | 6/1987 | Blumle | 83/100 X |
| 4,823,659 | A | * | 4/1989 | Falasconi | 83/100 |
| 4,878,407 | A | * | 11/1989 | Harrison et al. | 83/663 X |
| 5,088,367 | A | * | 2/1992 | Cracchiolo et al. | 83/663 X |
| 5,109,741 | A | * | 5/1992 | Fuchs | 83/100 |
| 5,555,786 | A | | 9/1996 | Fuller | 83/663 |
| 5,570,620 | A | * | 11/1996 | Okonski et al. | 83/698.42 X |
| 5,697,277 | A | * | 12/1997 | Okonski et al. | 83/663 X |
| 5,782,156 | A | | 7/1998 | Collins | 83/331 |
| 6,026,725 | A | * | 2/2000 | Okonski | 83/698.21 |
| 6,076,444 | A | * | 6/2000 | Okonski | 83/698.21 X |
| 6,119,570 | A | * | 9/2000 | Okonski et al. | 83/698.42 X |
| 6,205,899 | B1 | * | 3/2001 | Blumle et al. | 83/100 X |

FOREIGN PATENT DOCUMENTS

| | | |
|---|---|---|
| DE | 33 02 038 | 7/1984 |
| DE | 40 00 078 | 7/1991 |
| DE | 296 03 669 | 5/1996 |
| DE | 198 41 834 | 3/2000 |
| EP | 0 312 422 | 4/1989 |
| EP | 0 608 152 | 1/1994 |
| EP | 0 862 973 | 4/1995 |
| EP | 0 728 560 | 1/1996 |
| GB | 2 133 734 | 8/1984 |
| WO | WO 95/28261 | 10/1995 |
| WO | WO 95/31316 | 11/1995 |

* cited by examiner

*Primary Examiner*—Charles Goodman
(74) *Attorney, Agent, or Firm*—Collard & Roe, P.C.

(57) ABSTRACT

The application relates to a device for quickly and precisely aligning and fixing foil blades on the body part of a blade roll. The rotary blade roll has a rotating shaft, at least one roll body part arranged with torsional strength on the rotating shaft, at least one foil blade supported by the roll body part, and a row of holding and positioning pins in the roll body part. Magnetic elements arranged in rows retain the foil blade flatly on the peripheral surface of the roll body part. The foil blade has a thin flexible magnetically permeable base plate and at least one sharp one-piece cutting edge of a predetermined cutting shape projecting from the base plate. The base plate has a leading edge, a trailing edge, two side edges opposing each other, and, in a front zone adjoining the leading edge, a plurality of slots aligned with the cutting edge. The holding and positioning pins radially project from the peripheral surface with a height (h) approximately corresponding to the base plate thickness ($d_1$) and project into the slots. The width ($b_1$) of the pins corresponds with the slot width (b) so that the foil blade can be axially displaced and repositioned within the range of the slot length ($d_5$) while being fixed and reproducibly positioned peripherally to the roll body part.

9 Claims, 6 Drawing Sheets

ROTARY BLADE ROLL

BACKGROUND OF THE INVENTION

1. Field of Invention

The invention relates to a blade roll, preferably for the manufacture of letter envelope blanks as more particularly set forth herein.

2. The Prior Art

A blade roll of this type is known from DE 33 02 038 to the same applicant. It serves for cutting out window openings in blanks of window letter envelopes. In connection with this blade roll, a foil blade of the type similar to a printing plate is mounted on a punching roll and held there by purely mechanical means. The foil blade, which is chamfered at its ends, is suspended on a carrier part, and clamped and tensioned at its trailing end by means of holding and tensioning means. The blades always must have a defined length between their fastening elements, and require precisely executed chamfers. Furthermore, the mounting or exchanging of a foil blade requires substantial time expenditure.

It is also known according to applicant's DE 198 41 834.5 to arrange foil blades on a blade roll. The foil blade is fixed in this connection with a chamfered front end in a slot of the roll with the help of a clamping strip. The remaining part of the foil blade is held on the periphery of a blade cylinder by means of magnetic force, the cylinder being structured in the form of a dish. The manufacture of the roll slot and clamping strip as well as of the chamfer of the foil blade requires high precision and labor expenditure. Furthermore, the clamping strip has to be removed and installed with each blade exchange.

EP 0 312 422 B1 discloses a rotating cutting device in connection with which a foil blade for punching out window openings is held on the periphery of a dish-like blade cylinder by magnetic force alone. For positioning a foil blade on the blade cylinder, the leading edge of the foil blade is fixed and aligned on a strip slightly projecting beyond the periphery of the cylinder. The cutting device does in fact permit quick positioning and fixing of a foil blade on the blade cylinder; however, it has the drawback that the foil blade can get displaced on the blade cylinder under unfavorable cutting conditions, or even may get destroyed in the worst case. Therefore, cutting is possible with the blade roll against a jointly rotating counter roll, but no cutting is possible against a stationary counter bar.

The invention is concerned with the problem of designing a blade roll in particular for the manufacture of letter envelopes so that foil blades arranged on its roll jacket can be quickly exchanged and positioned and fixed with adequate accuracy.

SUMMARY OF THE INVENTION

The problem is solved according to the invention by arranging holding and positioning pins in a row in the roll body part. The pins radially project from the peripheral surface with a height (h) approximately corresponding with a thickness ($d_1$) of the base plate. In a front zone adjoining the leading edge, the base plate has a number of slots aligned in one alignment with the cutting edge. The width (b) of the slots corresponds with the width ($b_1$) of the holding and positioning pins projecting into the slots. In this way, the foil blade can be axially displaced and repositioned within the range of a slot length ($d_5$), but is fixed and reproducibly positioned in the peripheral direction of the roll body part. Additional features of the invention are set forth below in association with the description and the drawing.

The invention has the particular advantage that the foil blades can be quickly and comfortably positioned and replaced on the blade roll. The foil blades are held here on the peripheral surface of the blade roll both positively by the holding and positioning pins engaging the slots of the base plate, and retained there non-positively by magnetic holding forces. Also, it is advantageous that the foil blade can be displaced axially parallel on the blade roll as the holding and positioning pins are being inserted into the slots. A variable axially parallel positioning of the foil blade is possible in connection with a slightly asymmetric arrangement of the holding and positioning pins on a strip. Another advantage is that the blade roll as defined by the invention can use conventional foil blades of the type described in the parallel application DE 198 41 834.5, with angularly chamfered leading ends and clamping strips adapted to such ends.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
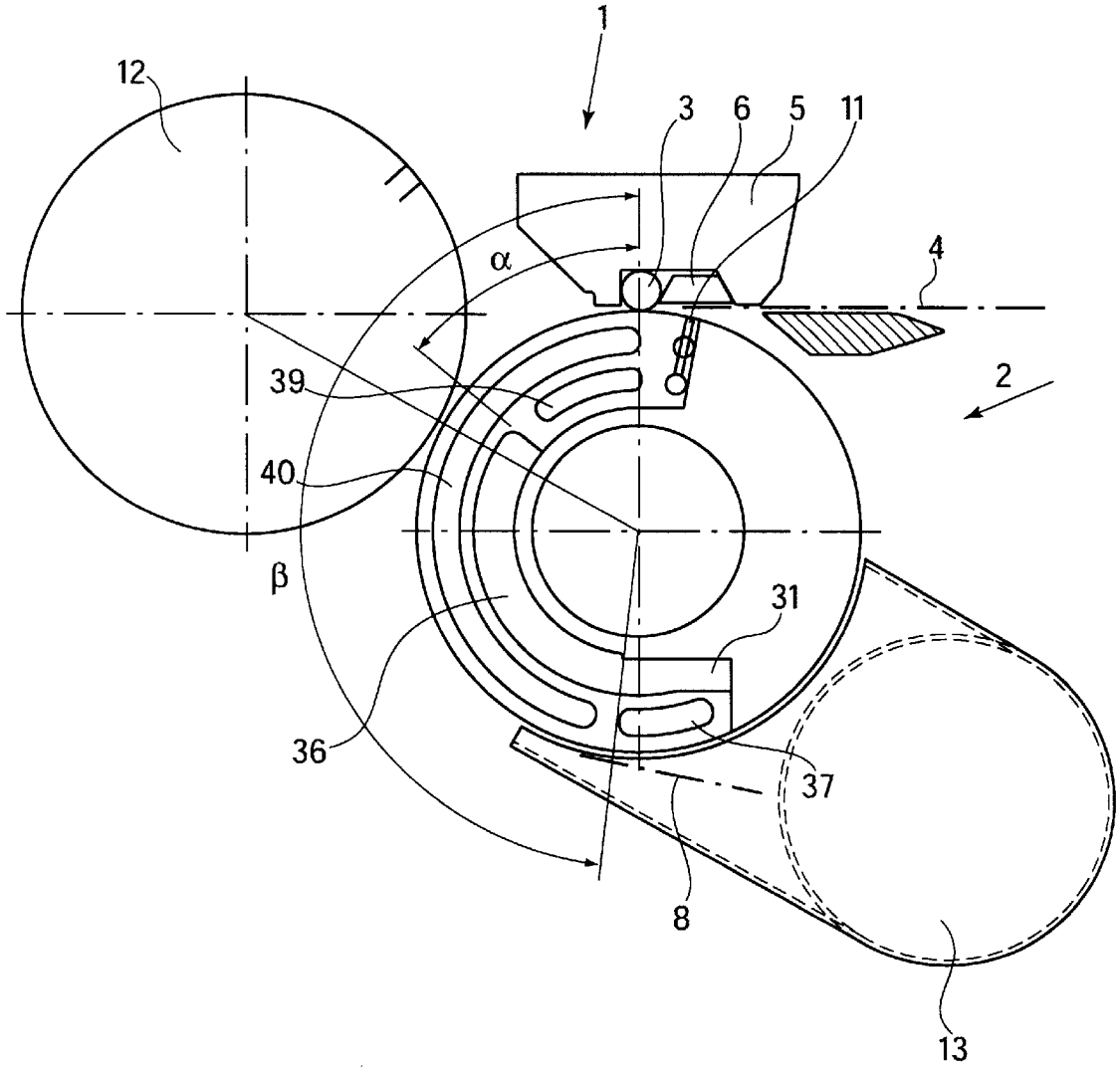
FIG. 1 is a diagrammatic sketch of a cutting station with a blade roll and a stationary counter tool.
Figure 2:
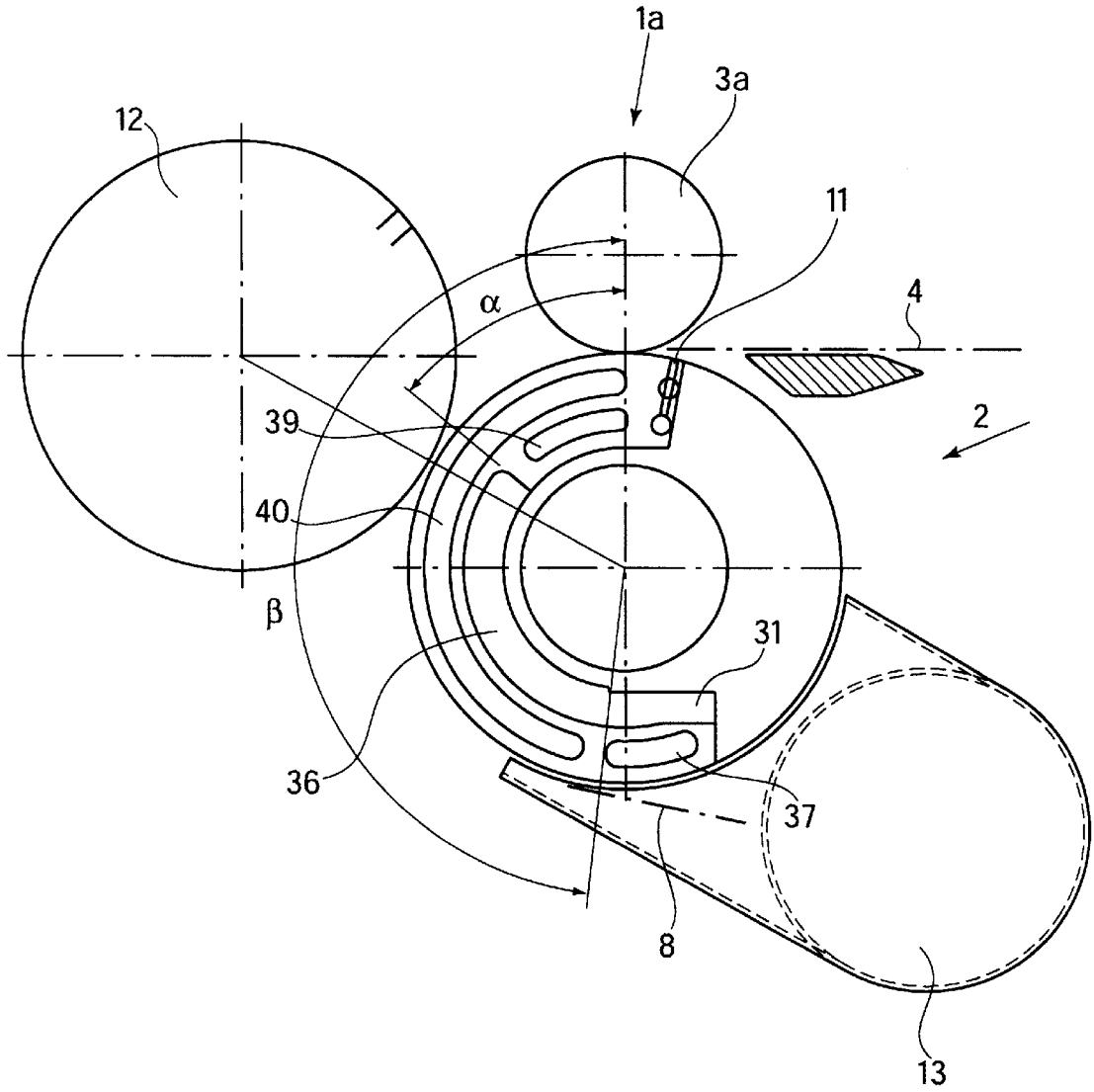
FIG. 2 is a diagrammatic sketch of a cutting station with a blade roll and a rotating counter roll.

According to the embodiment shown in FIG. 1, a cutting station 1 for window letter envelopes comprises a blade roll 2 and a cutting bar 3 serving as the counter tool. A sequence of letter envelope blanks 4 or a web of letter envelopes is passed through and processed between the blade roll and the cutting bar. Cutting bar 3 is supported in a carrier 5 and clamped there by a strip 6, and movable jointly with the carrier against or away from blade roll 2. The cutting station la shown in FIG. 2 has a rotating counter roll 3*a* as the opposing tool to blade roll 2. Letter envelope blank 4 coming from a straight-line conveyor belt is seized by blade roll 2 and guided through along a circular track under the counter tool, cutting bar 3 or counter roll 3*a*, whereby a window opening 8' is cut out. The blade roll 2 (FIGS. 4 and 5) has a multitude of suction openings 11 arranged in the rows 10 located along its periphery 9. This arrangement permits taking over and transporting a letter envelope blank 4 and a window cutout or material piece 8 cut from a window opening 8'. The letter envelope blank 4 is retained on blade roll 2 by means of suction air across a suction and transport angle range , and subsequently transferred to a roll 12. Material piece 8 is retained on the periphery of the window blade by suction air and, after passing through a suction and transport angle range β, delivered to a suction funnel 13.

Figure 3:
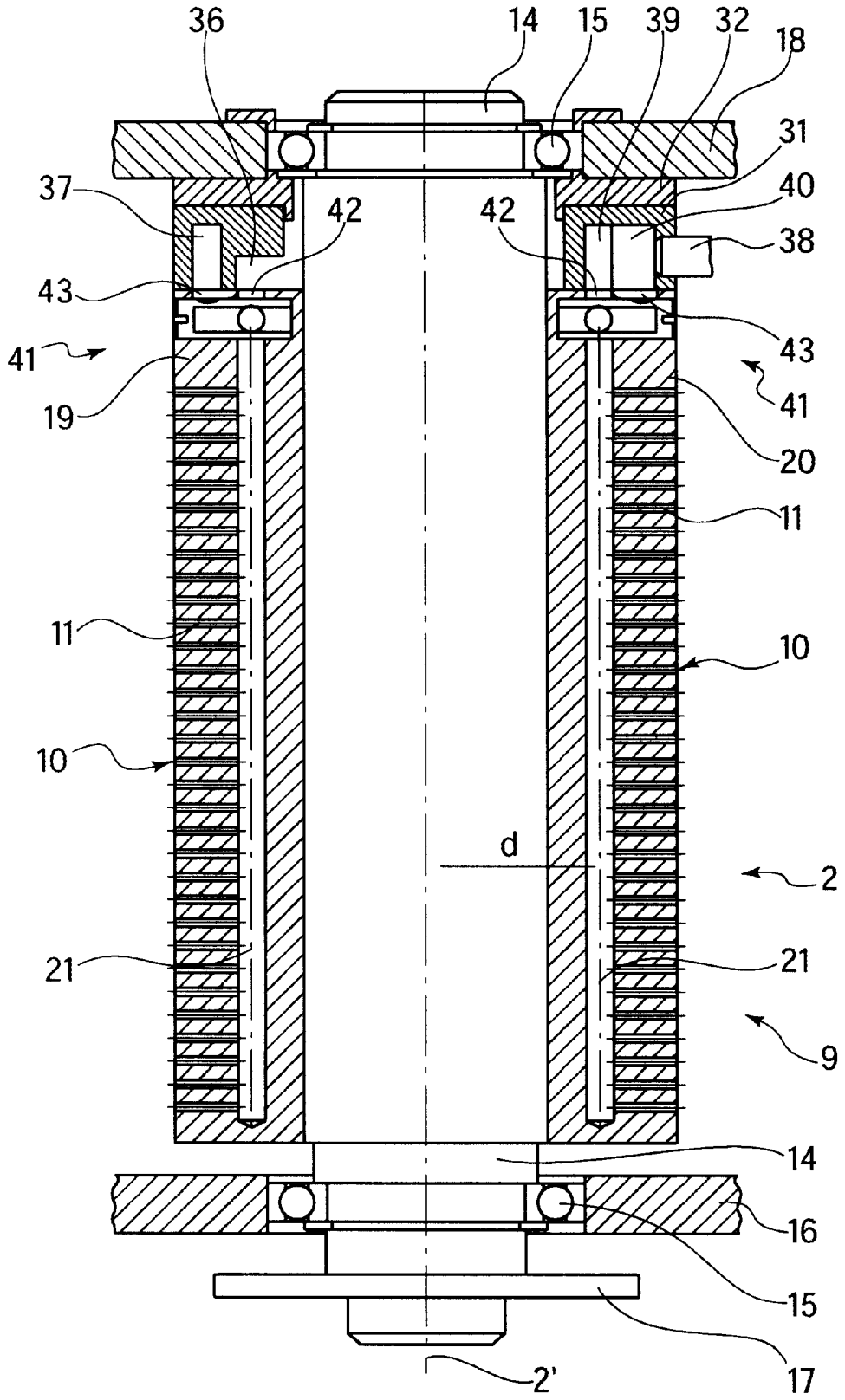
FIG. 3 is a sectional view of important components of the blade roll and its bearing.

FIG. 3 shows a sectional view of blade roll 2, its bearing and its important components, but without the foil blade and without the components for securing and aligning a foil blade.

Blade roll 2 comprises a supporting shaft 14, which is supported in the machine frames 16, 18 with the help of the ball bearings 15 and driven by means of a toothed gear 17. A cylindrical roll body part 19 is supported with torsional strength on the supporting shaft 14 between the machine frames 16, 18. The suction openings 11 are arranged on the periphery of part 19. The suction ducts 21 are axially parallel arranged in roll body part 19 with a spacing d from the axis of rotation 2' of blade roll 2. A suction air control valve 31 is arranged on roll body part 19 on the face side and torsionally fixed on frame wall 18 by a spacing and centering sleeve 32. Suction air control valve 31 has two separate, concentrically arranged suction air ducts 39, 40, and the fresh air ducts 36, 37 are arranged downstream of the suction air ducts. Suction air ducts 39, 40 are connected with a suction air source (not shown) via a suction air feed line 38. Suction air can be admitted through suction air ducts 39 and 40 to the suction air ducts 21 via the suction and transport angle ranges  and β, respectively. In the direction of suction air control valve 31, a 3/3-way valve 41 in roll body part 19 is associated with each suction duct 21. With a 3/3-way valve, a suction duct 21 can be closed or connected with suction air control duct 39 or 40 via the passage bore 42 or 43, respectively. The suction air control system including the 3/3-way valves is the object of applicant's parallel German application 198 41 834.5. The fresh air ducts 36 and 37 are arranged downstream of suction air ducts 39 and 40, respectively, and the vacuum in suction ducts 21 and suction openings 11 is canceled from the fresh air ducts.

Figure 4:
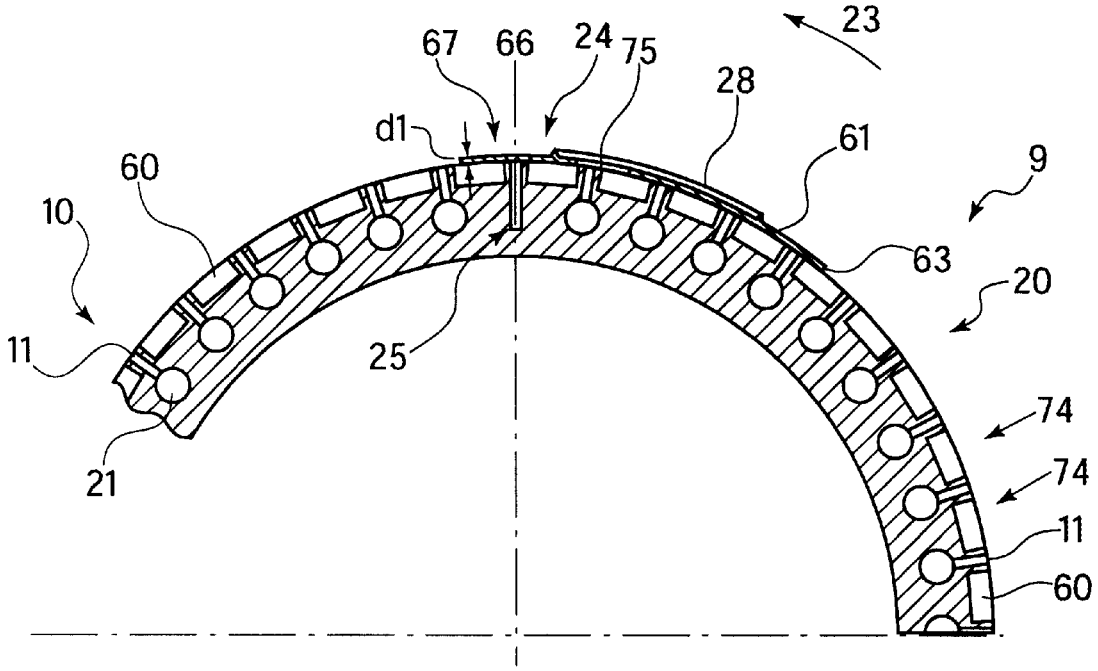
FIG. 4 shows a part section through the roll body part of the blade roll with the foil blade.
Figure 5:
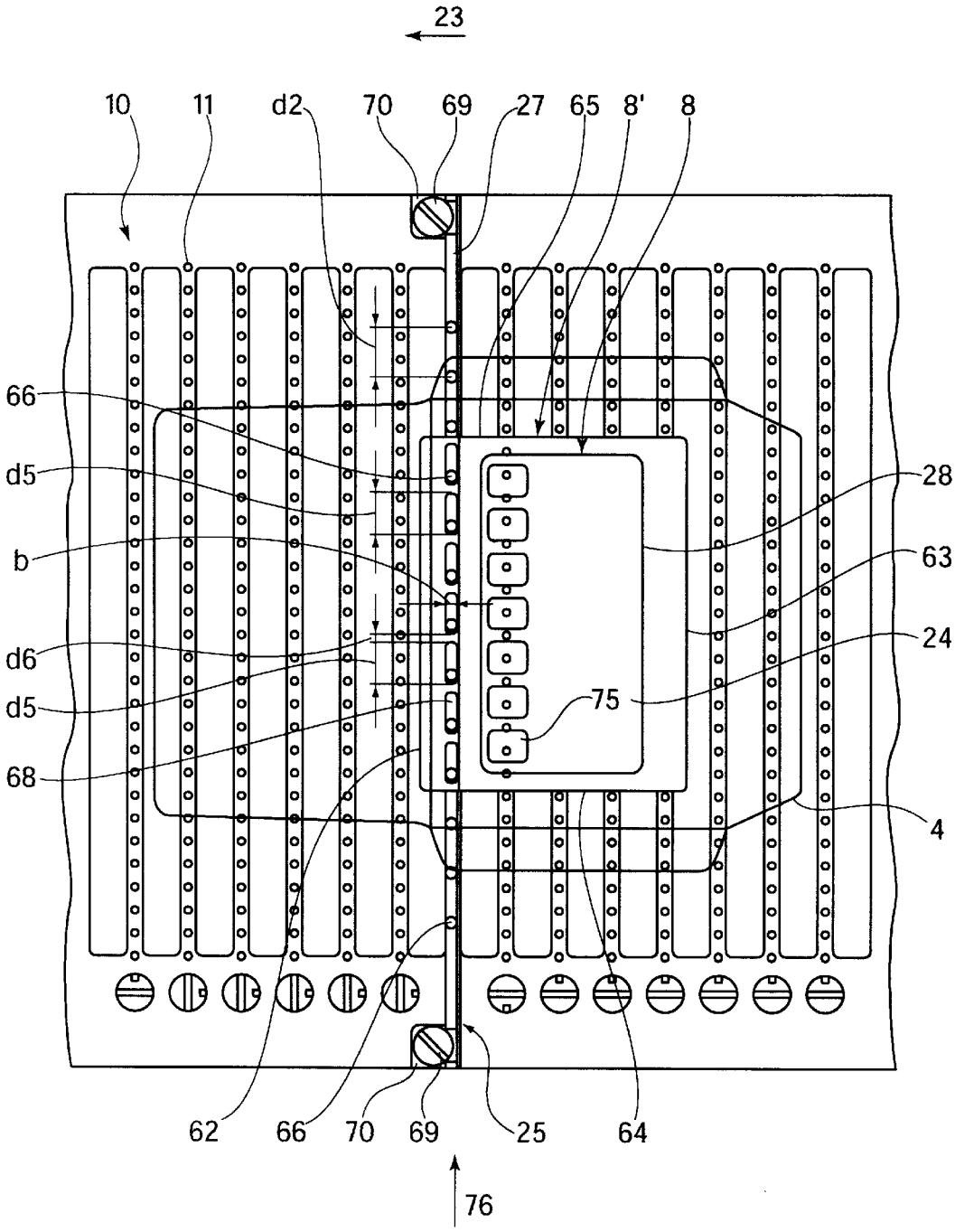
FIG. 5 is a layout of the roll body part with the foil blade and a letter envelope blank.

FIGS. 4 and 5 show the arrangement and fastening of a foil blade 24 of roll body part 19 of a blade roll 2 rotating in the direction of rotation 23. Foil blade 24 has a thin base plate 61 made of a magnetically permeable material with a thickness d1. The plate has a front edge 62 and a rear edge 63 and the side edges 64 and 65. At least one sharp cutting edge 28 consisting of one single piece is arranged on base plate 61, the cutting edge having a defined cutting shape. The breakthroughs 75 are arranged in foil blade 24, whose cutting edge 28 is designed for cutting out a window opening 8' in a letter envelope blank 4. The breakthroughs are connected in an air-conducting manner with suction bores 11. Viewed in the direction of rotation 23 of blade roll 2, the slots 68 are provided in base plate 61 in a zone 67 bordering on front edge 62. Slots 68 are aligned with each other in one line and have a width b, a length $d_5$ and a spacing $d_6$ between each other. Slots 68, cutting edge 28 and also front edge 62 are in predetermined, fixed positions relative to each other.

At least one row 76 of the holding and positioning pins 66 is arranged on the peripheral surface 20 of roll body part 19. The holding and positioning pins project radially from peripheral surface 20 with a height h, which approximately corresponds with the thickness $d_1$ of base plate 61. Holding and positioning pins 66 have a width $b_1$ and a spacing $d_2$ between one another. Width $b_1$ is dimensioned so that it corresponds with slot width b.

Furthermore, the magnetic elements 60 are arranged all around on peripheral surface 20 of roll body part 19 in the rows 74. Each row 74 alternates with a row 10 of suction air openings 11.

In order to exactly position and fix a foil blade 24 accurately on roll body part 19, the foil blade is suspended on holding and positioning pins 66, so that holding and positioning pins 66 project into slots 68. While it is being suspended, foil blade 24 is axially displaceable within the range of the slot length $d_5$. More extensive axial changes can be achieved by repositioning foil blade 24 in row 74 of holding and positioning pins 66. After being suspended, the foil blade is fixed positively in the peripheral direction by means of holding and positioning pins 66, and fixed non-positively on the roll body part by the magnetic elements. With this arrangement, foil blade 24 cannot get displaced on peripheral surface 20 even under difficult cutting conditions.

Figure 8:
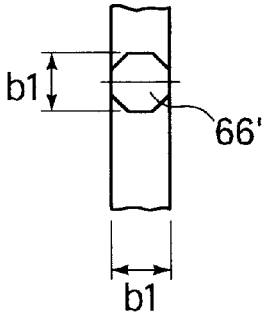
FIG. 8 shows a variation of a holding and positioning pin.
Figure 9:
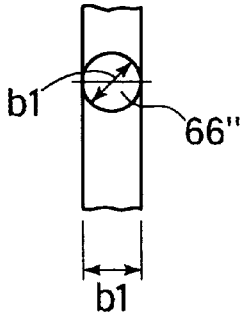
FIG. 9 shows another variation of a holding and positioning pin.
Figure 10:
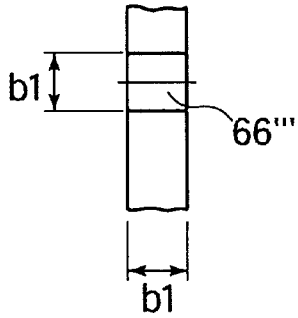
FIG. 10 shows another variation of a holding and positioning pin.

FIGS. 8 to 10 show a few variations of the design of holding and positioning pins designated a 66', 66" and 66'", respectively, in FIGS. 8–10.

Figure 11:
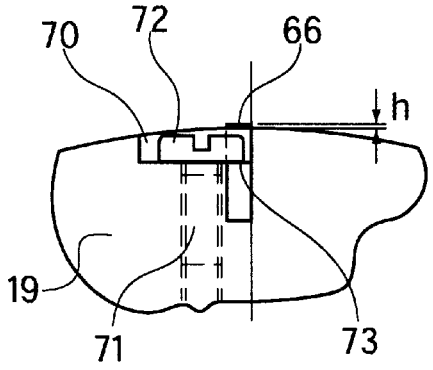
FIG. 11 shows the fastening of the strip.
Figure 6:
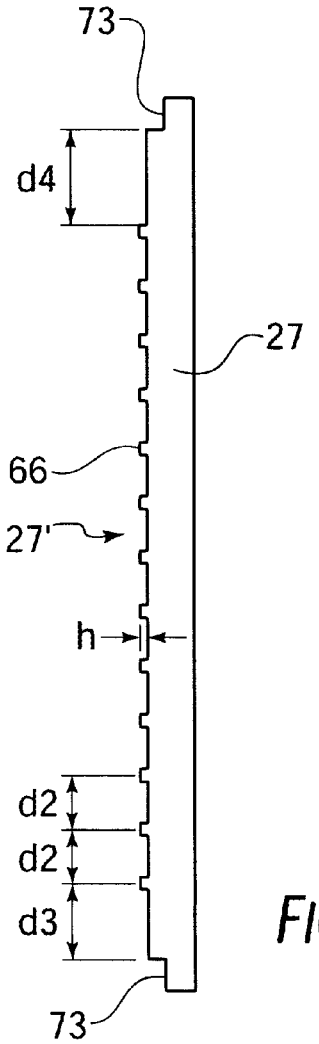
FIG. 6 is a side view of a strip.
Figure 7:
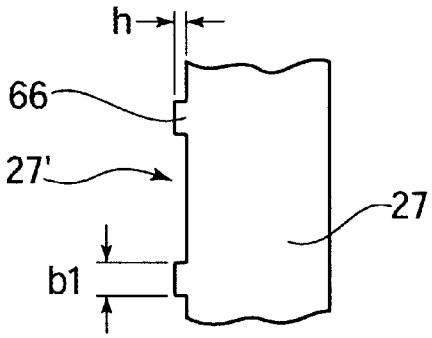
FIG. 7 is an enlarged cutout of a strip.

In a special embodiment of blade roll 2, holding and positioning pins 66 are molded onto a bar 27, which is exactly fitted into an axially parallel channel 25 of roll body part 19, and fixed there by means of the fastening elements 69. Bar 27 has a top side 27' shown in FIGS. 6 and 7, which is tangent to the peripheral surface 20 of roll body part 19. As shown in FIG. 11, the expanding recesses 70 are formed in the end zones of the channel 25. Approximately radially aligned threads feed into the recesses, and the set screws 71 are screwed into the threads. The set screws 71 apply pressure via their heads 72 to the pressure application surfaces 73 molded onto bar 27 at the ends, and thereby fix bar 27 in channel 25. On bar 27, holding and positioning pins 66 are equally spaced from each other by a spacing $d_2$; however, towards pressure application surfaces 73, the pins have the different end spacings $d_3$ and $d_4$, whereby $d_4$ is greater than $d_3$ by $d_2/2$. Bar 27 can be turned in channel 25 by 180° with respect to its end spacings $d_3$ and $d_4$. By turning bar 27 combined with lateral displacement and repositioning of a foil blade 24 in relation to holding and positioning pins 66, any position of the blade on roll body part 19 is obtainable in the axial direction.

According to another design on blade roll 2 (not shown), several channels 25 are provided and distributed over peripheral surface 20. Bars 27 or only filler pieces are arranged in the channels depending on the requirements and the selected number and size of foil blades 2.

While several embodiments of the present invention have been shown and described, it will be obvious that many changes and modifications may be made thereunto without departing from the sprit and scope of the invention.

What is claimed is:

1. A rotary blade roll comprising:

(a) a rotating shaft;

(b) at least one roll body part arranged on the rotating shaft, said roll body part comprising;

(i) a peripheral surface; and (ii) a plurality of magnetic elements arranged in rows on the peripheral surface;

(c) at least one foil blade supported by the roll body part and retained flatly on the peripheral surface by the magnetic elements, said foil blade comprising:

(i) at least one cutting edge having a predetermined cutting shape;

(ii) a thin flexible base plate made of a magnetically permeable material, said cutting edge projecting from the base plate, said base plate having a thickness ($d_1$) and comprising a leading edge, a trailing edge, two side edges opposing each other, and, in a front zone adjoining the leading edge, a plurality of slots, each slot having a width (b) and a slot length ($d_5$) defining a positioning range for pins to be located;

(d) a plurality of holding and positioning pins arranged in a row in the roll body part, said pins radially projecting from the peripheral surface with a height (h) approximately corresponding to the thickness ($d_1$) of the base plate and projecting into said slots, said pins having a width ($b_1$) corresponding with the width (b) of said slots so that the foil blade can be axially displaced and repositioned within the positioning range of the slot length ($d_5$) while being fixed and reproducibly positioned peripherally to the roll body part;

(e) at least one axially parallel channel formed in the roll body part, said channel being open against the peripheral surface;

(f) a bar fitted into the channel, said bar having a top side tangent to the peripheral surface, said holding and positioning pins being molded onto said top side in an aligned row of pins; and (g) a plurality of fastening elements fixing the bar into the channel.

2. The blade roll according to claim 1 wherein:

(a) the bar comprises a plurality of end sides and a plurality of pressure application surfaces molded onto the bar on the end sides;

(b) the channel has a plurality of end zones and a plurality of expanding recesses formed in the end zones, said recesses having approximately radially aligned threads feeding into said recesses; and (c) said plurality of fastening elements comprise a plurality of set screws screwed into said threads, said set screws having heads applying pressure to the pressure application surfaces and fixing the bar in the channel.

3. The blade roll according to claim 1, wherein the holding and positioning pins have a spacing $d_2$ between each other, and an end spacing $d_3$ on one side of said pins and an end spacing $d_4$ on the other side of said pins, said end spacing $d_4$ being greater than $d_3$ by $d_2/2$.

4. The blade roll according to claim 3, wherein the foil blades have a slot length $d_5$ less than the spacing $d_2$, and a spacing $d_6$ from slot to slot, wherein $d_6$ is equal to the spacing $d_2$ minus the spacing $d_5$.

5. The blade roll according to claim 3, wherein the bar is adapted to be (i) removed from a first position in the channel wherein the holding and positioning pins are at a first axial location and (ii) turned 180° and fitted into the channel at a second position wherein the holding and positioning pins are at a second axial position.

6. The blade roll according to claim 1, further comprising a channel arranged between each two rows of the magnetic elements.

7. The blade roll according to claim 1, wherein the roll body part has a plurality of suction air openings open against the peripheral surface for transporting items selected from the group consisting of letter envelope blanks and material pieces, said openings being adapted to be connected to a plurality of external supply and control ducts for admitting a pre-controlled vacuum.

8. The blade roll according to claim 7, wherein the suction air openings are arranged in axially parallel rows and are in fluid communication with at least one valve arranged on said roll body part for fluidly connecting or disconnecting said suction air openings from a suction air feed line supplying the pre-controlled vacuum.

9. The blade roll according to claim 7, further comprising breakthroughs provided in the foil blade in air-conducting connection with the suction openings of the roll body part.

* * * * *